US005154521A

United States Patent [19]

Tanaka et al.

[11] Patent Number: 5,154,521

[45] Date of Patent: Oct. 13, 1992

[54] PRINTER HAVING RIBBON MASK FOR REDUCING INTERFERENCE WITH RECORDING SHEET

[75] Inventors: Yoshiaki Tanaka, Shizuoka; Kozo Hara, Nakaizu; Kiyotaka Nihashi, all of Shizuoka, Japan

[73] Assignee: Tokyo Electric Co., Ltd., Tokyo, Japan

[21] Appl. No.: 700,258

[22] Filed: May 15, 1991

[30] Foreign Application Priority Data

May 16, 1990 [JP] Japan ..... 2-51077[U]

[51] Int. Cl.[5] ..... B41J 33/32

[52] U.S. Cl. ..... 400/247; 400/56

[58] Field of Search ..... 400/247, 248, 642, 616.1, 400/56

[56] References Cited

U.S. PATENT DOCUMENTS

| | | | |
|---|---|---|---|
| 4,492,484 | 1/1985 | Akazawa et al. | 400/248 |
| 4,688,955 | 8/1987 | Isobe et al. | 400/248 |
| 4,712,935 | 12/1987 | LaDue et al. | 400/247 |
| 4,856,923 | 8/1989 | Smith | 400/248 |
| 4,904,098 | 2/1990 | Hamilton | 400/248 |
| 4,929,102 | 5/1990 | Mizutani et al. | 400/248 |
| 4,960,337 | 10/1990 | Kato et al. | 400/642 |
| 4,964,556 | 10/1990 | Ferguson | 400/616.1 |

FOREIGN PATENT DOCUMENTS

| | | | |
|---|---|---|---|
| 0271320 | 6/1988 | European Pat. Off. | 400/248 |
| 3502470 | 1/1988 | Fed. Rep. of Germany . | |
| 60-29643 | 2/1985 | Japan . | |
| 0010479 | 1/1986 | Japan | 400/248 |
| 0023771 | 1/1987 | Japan | 400/248 |
| 62-151365 | 7/1987 | Japan . | |
| 0145068 | 6/1988 | Japan | 400/56 |
| 2108049 | 5/1983 | United Kingdom | 400/248 |
| 2209501 | 5/1989 | United Kingdom . | |

OTHER PUBLICATIONS

"Ribbon Shield of Printers" IBM Tech. Discl. Bulletin vol. 34, No. 5 Oct. 1991 pp. 9–10.

"Cardholder–Ribbon Guide Combination for Printers" IBM Tech. Discl. Bulletin, vol. 21, No. 12, May 1979 pp. 4744–4746.

"Ribbon Shield Structure for Printer" IBM Tech. Discl. Bulletin, vol. 26, No. 1, Jun. 1983, pp. 65–66.

*Primary Examiner*—Eugene H. Eickholt

*Attorney, Agent, or Firm*—Oblon, Spivak, McClelland, Maier & Neustadt

[57] ABSTRACT

In a printer having a platen, a print head disposed opposite to the platen, and a ribbon mask fixedly provided on the print head and having a masking plate provided with an aperture to expose only the front end of the print head to the platen, an ink ribbon is extended through a space between the platen and the print head, and the masking plate is disposed between the platen and the ink ribbon to shield a recording sheet wound round the platen from the ink ribbon. The aperture of the masking plate has inclined edges inclined to a direction perpendicular to the direction of movement of the print head so as to intersect a platen center obliquely. In case the side edge of a floating portion of the recording sheet is caught in the aperture of the masking plate while the print head is moved, the side edge slides along the inclined edge to escape from the aperture, so that the side edge is not caught in the aperture of the masking plate.

6 Claims, 3 Drawing Sheets

PRINTER HAVING RIBBON MASK FOR REDUCING INTERFERENCE WITH RECORDING SHEET

FIELD OF THE INVENTION AND RELATED ART STATEMENT

The present invention relates to a printer having a platen around which a recording sheet is wound for printing and, more particularly, to an impact serial printer.

A conventional impact serial printer will be described with reference to FIGS. 5 to 9. A cylindrical platen 1 is driven for rotation by a platen driving unit, not shown. A carriage guide shaft 4 is extended with its axis in parallel to that of the platen 1, and a carriage 3 mounted with a print head 2 is supported on the carriage guide shaft 4 for sliding movement along the carriage guide shaft 4. The carriage 3 is driven for back-and-forth movement by a carriage driving unit, not shown. The print head 2 is of a dot matrix print type provided on its front end with a plurality of wires 2*a* having front ends arranged in a single column. A wire driving unit moves the wires 2*a* back and forth. The print head 2 is disposed with the front ends of the wires 2*a* opposite the platen 1 with a small gap therebetween. The print head 2 may be provided with a plurality of wires having front ends arranged in two or more columns instead of a single column.

A ribbon mask 10 is attached to the carriage 3 so as to be positioned between the platen 1 and the print head 2. The ribbon mask 10 consists of a frame 10*a* screwed to the carriage 3, and a very thin, filmy masking plate 10*b* attached to the frame 10*a*. The masking plate 10*b* is provided with an aperture 11 through which the front ends of the wires 2*a* provided on the front end of the print head 2 are allowed to project. The shape of the aperture 11 is a rhombus (FIG. 7), an ellipse (FIG. 8) or a hexagon (FIG. 9). The aperture 11 of either shape is symmetric with respect to a platen center C, which is a normal to the platen 1 at a position on the platen nearest to the front end of the print head 2. Accordingly, a portion of the ribbon mask 10 corresponding to the platen center C is nearest to the platen 1 as well as the front end of the print head 2. The platen center C in FIGS. 7, 8 and 9 is a path along which a point on the print head 2 corresponding to the platen center C moves as the print head 2 moves.

A ribbon feed mechanism, not shown, is mounted on the carriage 3 to feed an ink ribbon 5 through a space between the platen 1 and the print head 2. As shown in FIG. 6, the ink ribbon 5 extends behind the ribbon mask 10 on the side of the print head 2.

A recording sheet P is fed between the platen 1 and the ribbon mask 10, and then the wires 2*a* of the print head 2 are driven selectively to impact the platen 1 with the front ends of the wires 2*a*; consequently, portions of the ink ribbon 5 corresponding to the wires 2*a* impacting on the platen 1 are transferred to the recording sheet P to print dots. The carriage 3 is driven by the carriage driving unit to print a line of characters by moving the print head 2 along the axis of the platen 1 in a direction indicated by double-head arrow X in FIG. 5. Such a printing operation is repeated every time the platen 1 is turned through an angle corresponding to the line spacing to print all the lines of characters on the recording sheet P.

Since the recording sheet P is shielded with the ribbon mask 10 from the ink ribbon 5, the recording sheet P can surely be prevented from being smeared with the ink of the ink ribbon 5 as the print head 2 is moved back and forth along the platen 1.

However, this prior art has the following drawbacks. It is possible that a portion of the recording sheet P wound round the platen 1 corresponding to the platen center C floats slightly from the platen 1 and, in some cases, the edge of the aperture 11 of the ribbon mask 10 interferes with the side edge of the recording sheet P while the print head 2 is moved back and forth. The interference between the edge of the aperture 11 and the side edge of the recording sheet P may cause jamming or may damage the ribbon mask 10.

OBJECT AND SUMMARY OF THE INVENTION

It is an object of the present invention to provide a printer having a ribbon mask, capable of preventing the interference between the aperture of the ribbon mask and the recording sheet.

To achieve the object, the present invention disposes a platen and a print head supported for sliding movement along the platen opposite to each other, extends an ink ribbon through a space between the platen and the print head, fixedly provides a ribbon mask having an aperture so as to expose only the front end of the print head to the platen provided on the print head and so that the inclined edges thereof inclined to a direction perpendicular to the direction of movement of the print head extend across the platen center. The platen center is a normal to the platen at a position nearest to the front end of the print head. Characters are printed on a recording sheet wound round the platen while the print head is moved back and forth and the platen is turned for feeding the recording sheet. Since the recording sheet is shielded from the ink ribbon by the ribbon mask, the recording sheet is not smeared accidentally by the ink. Since the floating edges the recording sheet are able to slide along the inclined edges of the aperture even if the floating edges of the recording sheet are caught by the edges of the aperture, the recording sheet is not caught by the aperture and hence jamming and breakage of the ribbon mask can be prevented.

DESCRIPTION OF THE PREFERRED EMBODIMENTS

Figure 1:
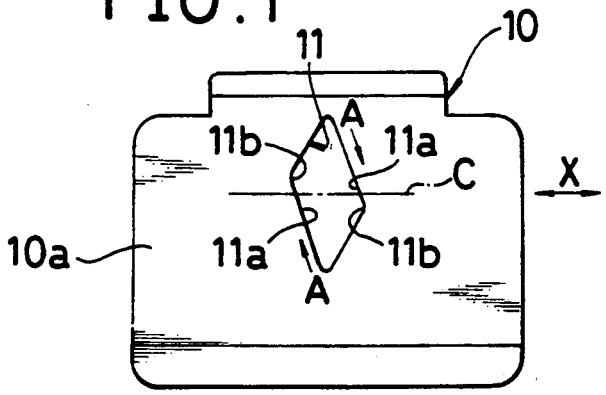
FIG. 1 is a front view of a masking plate for a ribbon mask employed in a printer in a preferred embodiment according to the present invention.
Figure 2:
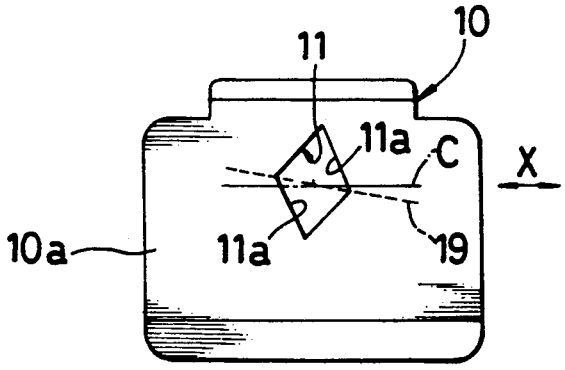
FIG. 2 is a front view of a masking plate in a modification included in the ribbon mask.
Figure 3:
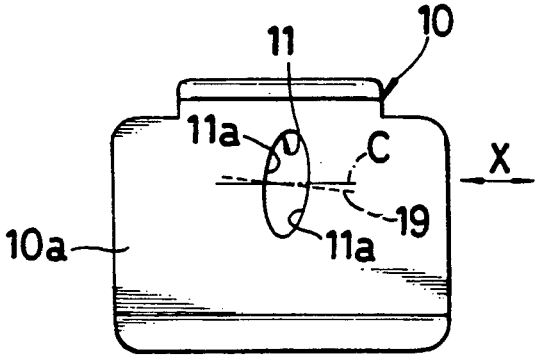
FIG. 3 is a front view of a masking plate in another modification for the ribbon mask.
Figure 4:
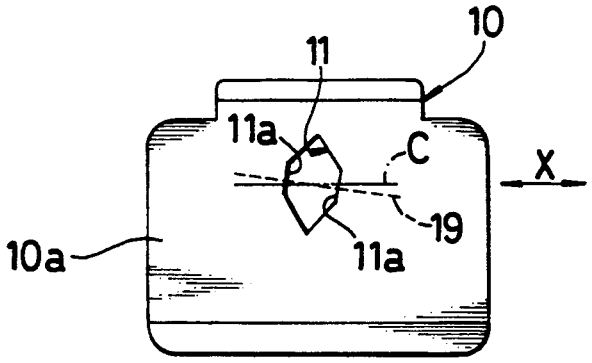
FIG. 4 is a front view of a masking plate in a further modification for the ribbon mask.
Figure 5:
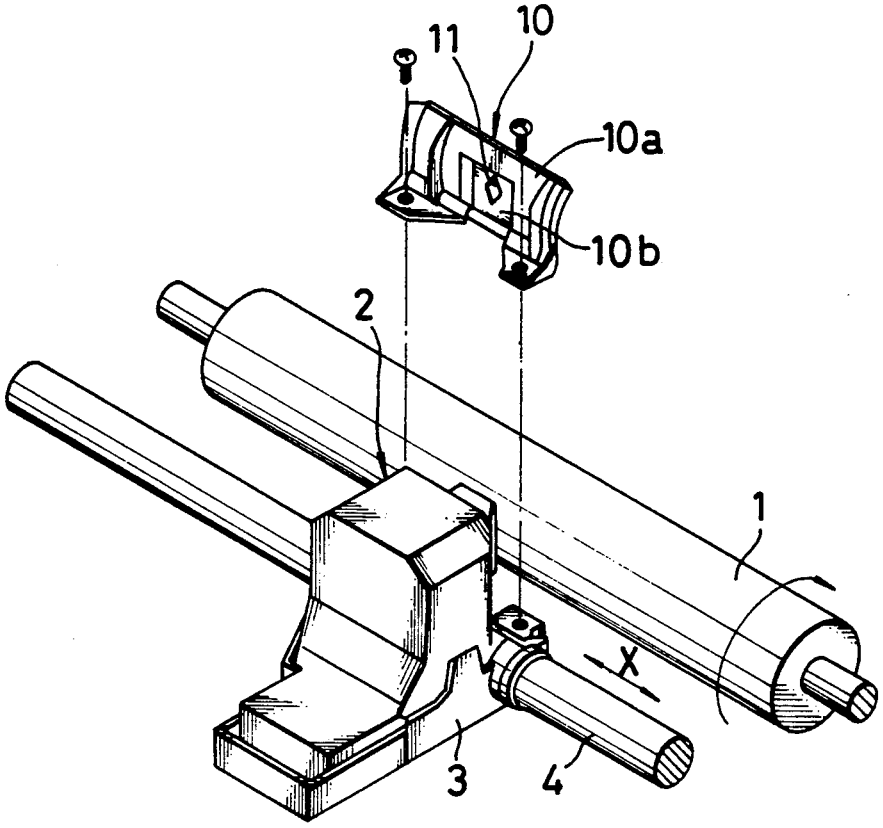
FIG. 5 is a perspective view of a portion of a conventional printer.
Figure 6:
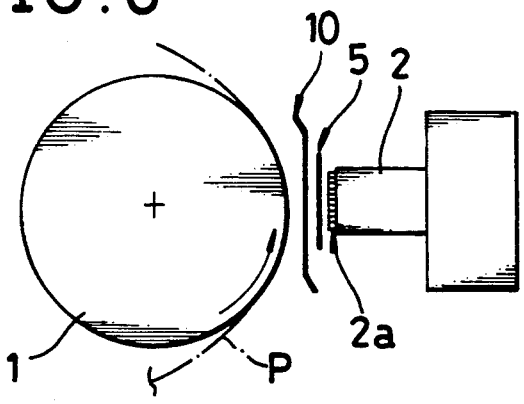
FIG. 6 is a side view of assistance in explaining the positional relation between a platen, a print head, an ink ribbon and a ribbon mask.
Figure 7:
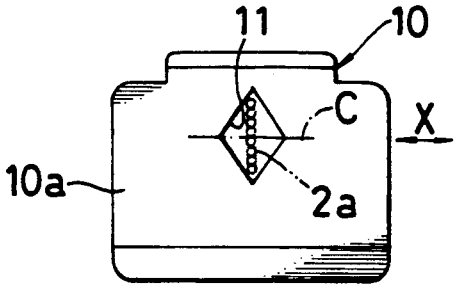
FIG. 7 is a front view of a masking plate for a ribbon mask.
Figure 8:
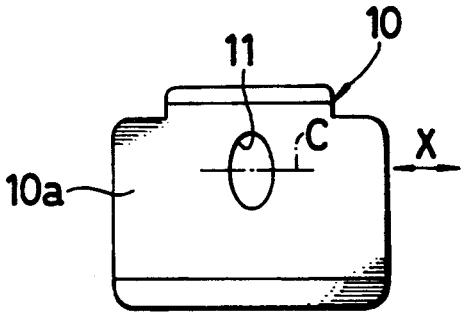
FIG. 8 is a front view of another masking plate for a ribbon mask.
Figure 9:
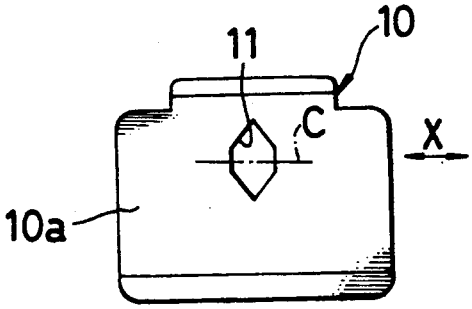
FIG. 9 is a front view of a further masking plate for a ribbon mask.

A printer in a preferred embodiment according to the present invention will be described with reference to FIG. 1, in which parts like or corresponding to those previously described with reference to FIGS. 5 to 9 are denoted by the same reference characters and the description thereof will be omitted. A ribbon mask 10 has a masking plate 10*a* provided with a parallelogrammatic aperture 11 having opposite edges 11*a* inclined to a direction perpendicular to the direction of movement of the print head 2 indicated by a double-head arrow X in FIG. 1 and formed so as to extend across a platen center C, namely, a normal to the platen 1 at a position nearest to the front end of the print head 2. A point on the print head 2 coinciding with the platen center C moves along the platen center C as the print head 2 moves. Platen centers C shown in FIGS. 2 to 4 are of the same definition.

In case a portion of the side edge of a recording sheet P slightly floating from the platen 1 enters the aperture 11 during printing operation in which the print head 2 is moved back and forth, the side edge of the recording sheet P slides along the inclined edge 11*a* past the platen center C in the direction of an arrow A toward a corner 11*b* of the aperture 11. Thus, the recording sheet P escapes from the aperture 11, so that printing operation is continued smoothly without entailing the jamming of the recording sheet P and without damaging the ribbon mask 10.

Since the aperture 11 has a polygonal shape, the least necessary area of the front end of the print head 2 is exposed to the platen 1 to shield the recording sheet P effectively from the ink ribbon 5, the inclined edges 11*a* inclining at a large angle to the platen center C ensures the escape of the recording sheet P from the platen center C.

Since the aperture 11 is designed in a shape effective for preventing the recording sheet P being caught by the aperture 11, the ribbon mask (hence the printer) is simple in construction and small in size.

The shape of the aperture 11 of the ribbon mask 10 need not necessarily be a parallelogram; the aperture 11 may be of any shape provided that the aperture 11 has inclined edges 11*a* intersecting the platen center C.

For example, the ribbon mask 10 may employ a masking plate 10*a* provided with an aperture 11 having the shape of a rhombus and formed with its horizontal axis of symmetry vertically dislocated from the platen center C or inclined at a predetermined angle to the platen center C as shown in FIG. 2 so that the inclined edges 11*a* thereof intersect the platen center C obliquely.

The ribbon mask 10 may employ a masking plate 10*a* provided with an aperture 11 having the shape of an ellipse formed with its axis of symmetry dislocated vertically from the platen center C or inclined at a predetermined angle to the platen center C as shown in FIG. 3 so that a portions 11*a* of the elliptic aperture 11 intersect the platen center C obliquely. Since the edge of the aperture 11 is a smooth curve, the recording sheet P being caught by the aperture 11 can be prevented even if the angle of inclination of the inclined portions 11*a* is small.

Furthermore, the ribbon mask 10 may employ a masking plate 10*a* provided with an aperture 11 having the shape of a hexagon formed with its axis of symmetry dislocated vertically from the platen center C or inclined at a predetermined angel to the platen center C as shown in FIG. 4 so that inclined edges 11*a* thereof intersect the platen center C obliquely.

What is claimed is:

1. A printer comprising:

a platen a print head disposed with its front end facing the platen and supported for sliding movement parallel to the axis of the platen; and a ribbon mask fixedly provided on the print head, and having a masking plate held between the platen and an ink ribbon extending through a space between the platen and the print head, and provided with an aperture for exposing only the front end of the print head to the platen;

wherein the aperture includes peripheral edge portions which define a shape of the aperture when viewed in a direction from the print head toward the platen, said peripheral edge portions including inclined edges which are inclined with respect to a direction perpendicular to the direction of movement of the print head and formed so as to intersect and extend across a platen center obliquely thereby reducing interference between the mask and a sheet on said platen as a result of the inclined edges which allow edges of a sheet to slide there along when an edge passes into said aperture, such that an edge is more readily freed from said aperture.

2. A printer according to claim 1, wherein the aperture of the masking plate has the shape of a polygon.

3. A printer according to claim 1, wherein the aperture of the masking plate has the shape of an ellipse.

4. A printer comprising:

a platen;

a print head having a front end facing the platen and supported for movement parallel to the axis of the platen; and a ribbon mask fixedly provided on the print head and having a masking plate held between the platen and an ink ribbon extending through a space between the platen and the print head, said mask having an aperture for exposing the front end of the printing head to the platen;

said aperture including peripheral edge portions defining a shape of the aperture when viewed in a direction from the print head toward the platen, said shape being substantially symmetrical about an axis of symmetry and wherein said axis of symmetry extends at an oblique angle with resect to a platen center, such that said shape is oriented to reduce interference between a sheet on said platen and the mask.

5. The printer of claim 4, wherein the aperture has a polygonal shape.

6. The printer of claim 4, wherein the aperture has an elliptical shape.

* * * * *